US005771434A

United States Patent [19]

Hokari

[11] Patent Number: 5,771,434

[45] Date of Patent: Jun. 23, 1998

[54] IMAGE FORMING APPARATUS

[75] Inventor: Norio Hokari, Ebina, Japan

[73] Assignee: Fuji Xerox Co., Ltd., Tokyo, Japan

[21] Appl. No.: 851,030

[22] Filed: May 5, 1997

[30] Foreign Application Priority Data

May 8, 1996 [JP] Japan ..... 8-137477

[51] Int. Cl.[6] ..... G03G 15/00

[52] U.S. Cl. ..... 399/400; 399/303; 399/316

[58] Field of Search ..... 399/298, 302, 399/303, 308, 312, 316, 317, 397, 400

[56] References Cited

U.S. PATENT DOCUMENTS

| | | | |
|---|---|---|---|
| 4,839,697 | 6/1989 | Kamitamari et al. | 399/316 |
| 5,063,415 | 11/1991 | Ariyama | 399/400 |
| 5,128,726 | 7/1992 | Cassano et al. | 399/303 X |
| 5,159,391 | 10/1992 | Koshi et al. | 399/316 |
| 5,337,128 | 8/1994 | Hashizume et al. | 399/316 X |
| 5,617,193 | 4/1997 | Ban et al. | 399/316 |

FOREIGN PATENT DOCUMENTS

| | | |
|---|---|---|
| A-5-107966 | 4/1993 | Japan . |
| A-6-9096 | 1/1994 | Japan . |

*Primary Examiner*—Sandra L. Brase
*Attorney, Agent, or Firm*—Oliff & Berridge PLC

[57] ABSTRACT

An image forming apparatus includes: a transferring and conveying body that transfers a nonfused image onto a transfer member and conveys the transfer member; a fusing apparatus that is arranged so as to be distanced from the transferring and conveying body a distance that is shorter than a maximum transfer length and fuses an image on the transfer member; and a transfer member guide that is interposed between the transferring and conveying body and the fusing apparatus and guides the transfer member to thread into a fusing nip region of the fusing apparatus. In such image forming apparatus, the transfer member guide has a guide position changing apparatus that changes the position of the transfer member guide in a direction that a loop of the transfer member is caused when the head end of the transfer member threads into the fusing nip region of the fusing apparatus.

13 Claims, 12 Drawing Sheets

IMAGE FORMING APPARATUS

BACKGROUND OF THE INVENTION

1. Field of the Invention

The invention relates to image forming apparatuses that not only transfer a nonfused image onto a transfer member and conveys the transfer member with a transferring and conveying body, but also fuses the nonfused image on the transfer member with a fusing apparatus. More particularly, the invention is directed to an improved image forming apparatus in which the transferring and conveying body is distanced from the fusing apparatus a length that is shorter than a maximum transfer member length and in which a transfer member guide for allowing the transfer member to thread into a fusing nip region of the fusing apparatus is interposed between the transferring and carrying body and the fusing apparatus. The image forming apparatus of the invention is particularly beneficial when applied to the production of multicolor images.

2. Description of the Related Art

The related art will be described by taking a conventional color image forming apparatus of a so-called tandem type as an example. A color image forming apparatus of this type, which is, e.g., shown in FIG. 16, has a plurality of image forming units 200 (200K, 200Y, 200M, 200C) that form images of different color components by means of electrophotography. Further, a sheet conveying belt 201 is arranged so that the sheet conveying belt 201 extends so as to confront image transfer regions of the respective image forming units 200; the images of different color components are transferred onto a sheet 202 conveyed by the sheet conveying belt 201; and the sheet 202 separated from the sheet conveying belt 201 is thereafter guided to a fusing apparatus 203, where a nonfused image on the sheet 202 is fused.

By the way, in the color image forming apparatus of this type, the following design has already been proposed to make the apparatus more compact. The distance between the sheet conveying belt 201 and a fusing nip region 203*a* of the fusing apparatus 203 is set to a value smaller than a maximum sheet length, and a sheet guide 205 is fixedly arranged between the sheet conveying belt 201 and the fusing apparatus 203, so that the sheet 202 is guided to thread into the fusing nip region 203*a* of the fusing apparatus 203. It may be noted that reference numeral 206 denotes a separating protuberance that forcibly separates the sheet 202 from the sheet conveying belt 201.

In this case, the position of a sheet guide 205 is predetermined in such a manner that not only the sheet 202 can be guided smoothly into the fusing nip region 203*a* but also a loop 202*a* formed on the sheet 202 for the reason that the sheet conveying speed of the fusing apparatus 203 is slower than the sheet conveying speed of the sheet conveying belt 201 at the timing at which the head end of the sheet 202 has threaded into the fusing nip region 203*a*, can be absorbed.

However, the conventional fixed sheet guide design such as described above attaches importance to the sheet 202 guiding function. Therefore, when the degree of inclination of the sheet guide 205 is set to a small value, the sheet guide 205 cannot absorb the loop 202*a* effectively, whereas when the degree of inclination of the sheet guide 205 is set to a large value, the loop 202 can be absorbed effectively, but the head end of the sheet 202 cannot be guided smoothly along the sheet guide 205 surface due to a discrepancy between the sharp sheet guide 205 surface and the sheet 202 colliding position, and this prevents smooth guidance of the head end of the sheet 202 along the sheet guide 205 surface. As a result, the positioning of the sheet guide 202 has been extremely cumbersome.

Further, as shown in FIG. 17, the sheet 202 is unevenly nipped across the width thereof at the time the head end of the sheet 202 threads into the fusing nip region 203*a* since a direction A in which the sheet 202 is conveyed by the sheet conveying belt 201 is slightly different from a direction B in which the sheet 202 is conveyed by the fusing apparatus 203 due to installation errors of the sheet conveying belt 201 and the fusing apparatus 203. As a result, the sheet 202 is displaced unevenly in a direction (across the width) substantially orthogonal to the sheet 202 travelling direction as indicated by the two dot chain line in FIG. 17.

On the other hand, after the timing at which the sheet 202 has threaded into the fusing nip region 203*a*, the loop 202*a* is produced on the sheet 202, and the shape of the loop 202*a* is regulated with the loop 202*a* that urges the sheet guide 205.

Under this condition, the sheet conveying belt 201 comes of meander in a direction indicated by the arrow C while receiving a reaction force of the sheet 202 that has been displaced across the width thereof. From this arise technical problems such as image distortion and defective color superimposition on the sheet during transferring operation by each image forming unit 200 and damaged belt edge due to sideward displacement of the sheet conveying belt 201.

In order to overcome these technical problems, the present applicant has proposed the following art. That is, a sensor for sensing the degree of looping of a sheet is arranged; the degree of looping of the sheet is judged in accordance with the sensor output; and the fusing apparatus speed is switched to a high speed when the degree of looping of the sheet exceeds a certain value, so that the loop of the sheet will not become too large (see Japanese Patent Unexamined Publication No. Hei. 5-107966).

However, the image forming apparatus of this type requires a sheet loop sensing means, a sheet loop judging means, and a fusing apparatus speed switching means.

Therefore, again imposed is a problem that the construction of the apparatus becomes complicated.

Moreover, another solution has been proposed. For example, the fusing apparatus is moved in accordance with the size of a sheet used, and a sheet guide (movable belt) whose sheet guide length expands in accordance with the movement of the fusing apparatus is arranged between the fusing apparatus and the sheet conveying belt (see Japanese Patent Unexamined Publication No. Hei. 6-9096).

However, in this type, the fusing apparatus moving mechanism as well as the sheet guide length expanding mechanism for the sheet guide must be employed, which again complicates the construction of the apparatus. In addition, in order to prevent the meandering of the sheet conveying belt due to the reaction force of the sheet, the tail end of the sheet must be separated from the sheet conveying belt when the sheet threads into the fusing nip region of the fusing apparatus. This requirement runs counter to the implementation of the downsizing of the apparatus.

Such inconvenience occurs not only to the sheet conveying belt type systems. Even transfer drum type systems, indirect transfer systems using an intermediate transfer body such as an intermediate transfer belt, and direct transfer systems using an image carrying body such as a photosensitive drum and a photosensitive belt encounter the same inconvenience since a reaction force from the sheet guide to the sheet is applied to the transfer drum, the intermediate transfer body, and the image carrying body.

SUMMARY OF THE INVENTION

The invention has ben made to overcome the aforementioned technical problems. The object of the invention is to provide an image forming apparatus that not only contributes to effectively avoiding inconvenience caused to a transferring and conveying body by a reaction force applied from a transfer member guide to a transfer member (the inconvenience being such as image distortion and defective color superimposition due to meandering, as well as damaged edges), but also allows the transfer member to be guided stably to a fusing apparatus with a simple construction while meeting the requirement of making the apparatus more compact.

The foregoing object and other objects of the invention have been achieved by the provision of an image forming apparatus that includes: a transferring and conveying body for transferring a nonfused image onto a transfer member and conveying the transfer member; a fusing apparatus that is arranged so as to be distanced from the transferring and conveying body a distance that is shorter than a maximum transfer member length and that fuses an image on the transfer member; and a transfer member guide that is interposed between the transferring and conveying body and the fusing apparatus and that guides the transfer member to thread into a fusing nip region of the fusing apparatus. In such image forming apparatus, a guide position changing apparatus is arranged on the transfer member guide. The guide position changing apparatus changes a position of the transfer member guide in a direction that a loop of the transfer member is caused when a head end of the transfer member threads into the fusing nip region of the fusing apparatus.

DETAILED DESCRIPTION OF THE INVENTION

The invention will be described in detail based on the modes of embodiment shown in the accompanying drawings.

Mode of embodiment 1

Figure 2:
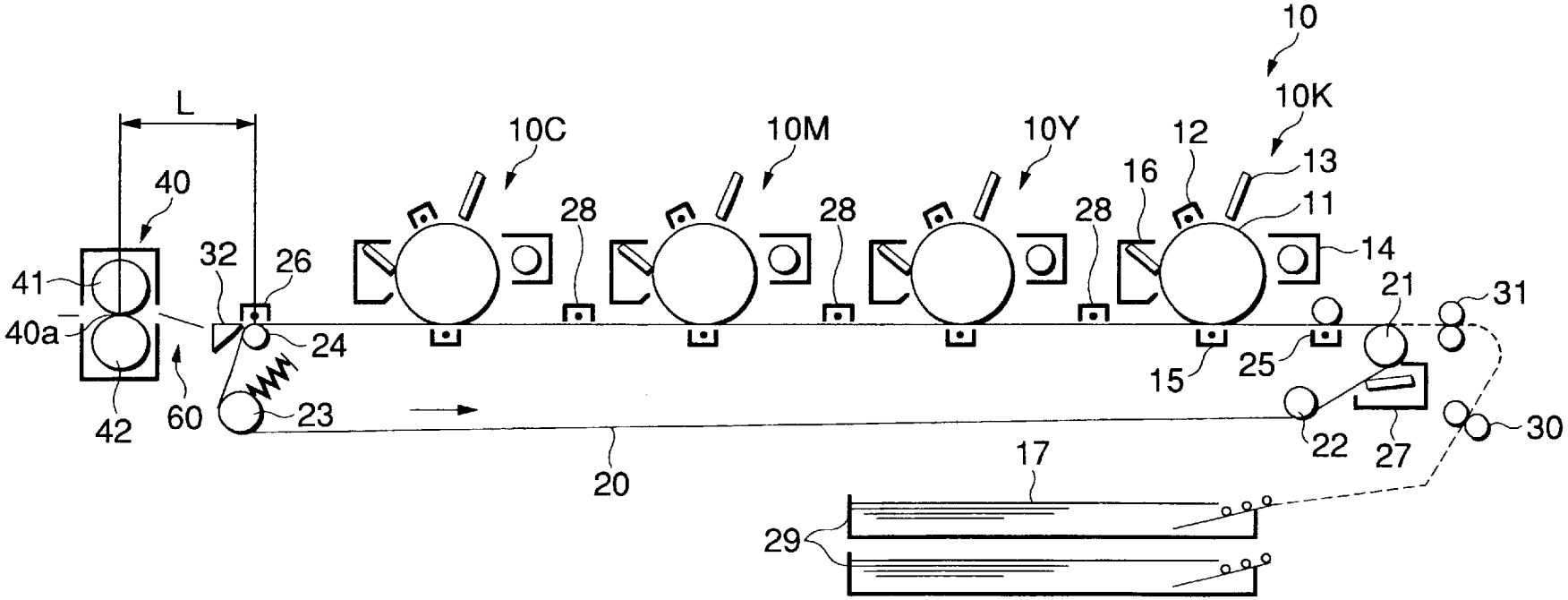
FIG. 2 is a diagram outlining the image forming apparatus, which is mode of embodiment 1.

FIG. 2 outlines a color image forming apparatus, which is mode of embodiment 1, to which the invention is applied.

In FIG. 2, the color image forming apparatus has image forming units 10 (specifically, 10K, 10Y, 10M, 10C) that generate developed images of different color components (black (K), yellow (Y), magenta (M), and cyan (C)). Each image forming unit 10 has, e.g., around a photosensitive drum 11, an electrostatically charging device 12, an image forming exposing device 13, a developing device 14 having a corresponding color toner contained therein, a transfer device 15 that transfers a corresponding color toner image onto a sheet 17, and a cleaner 16 that removes residual toner on the photosensitive drum 11.

An endless sheet conveying belt 20 is installed around a drive roll 21 and an appropriate number of idle rolls 22 to 24 so that the sheet conveying belt 20 extends so as to correspond to the transfer regions of the respective image forming units 10. The roll 23, which is one of the idle rolls, is used as a tension roll so that an appropriate tension is applied to the sheet conveying belt 20. It may be noted that each transfer device 15 is disposed so as to confront the photosensitive drum 11 through the sheet conveying belt 20.

Further, a sheet adsorbing device 25 that electrostatically adsorbs the sheet 17 by electrostatically charging the sheet conveying belt 20 is arranged upstream of the first transfer region of the sheet conveying belt 20 (the transfer region of the image forming unit 10K). On the other hand, a separating device 26 that separates the sheet 17 from the sheet conveying belt 20 by eliminating electrostatic charges from the sheet 17 is arranged downstream of the last transfer region (the transfer region of the image forming unit 10C). It may be noted that reference numeral 27 denotes a belt cleaner that removes paper powders or the like deposited on the sheet conveying belt 20; 28, a pre-transfer static eliminator device that eliminates the stored charge in the sheet conveying belt 20 to permits smooth transfer process; 29, a sheet tray that accommodates sheets 17 therein; and 30, 31, transfer rolls that transfer the sheet 17 inside the sheet trays 29 to the sheet transfer belt 20.

Further, in this mode of embodiment, an appropriate number of separating protuberances 32 that forcibly separate the sheet 17 are arranged in the vicinity of the separating device 26 of the sheet conveying belt 20 so as to extend across the width of the sheet 17.

A fusing apparatus 40 is arranged so as to be distanced from the sheet separating region of the sheet transfer belt 20.

A hot fusing method is employed in this fusing apparatus 40. The fusing apparatus 40 has a heat roll 41 with a built-in heater and a pressure roll 42 disposed so as to be in pressure contact with each other. A distance L between the sheet separating region of the sheet conveying belt 20 and the fusing nip region 40*a* of the heat roll 41 and pressure roll 42 is set to a value shorter than a maximum sheet length (the maximum sheet length being e.g., A3 size according to the JIS specifications in this mode of embodiment).

Further, a sheet guide mechanism 60 that guides the sheet 17 to the fusing nip region 40*a* is provided between the sheet conveying belt 20 and the fusing apparatus 40.

Figure 3:
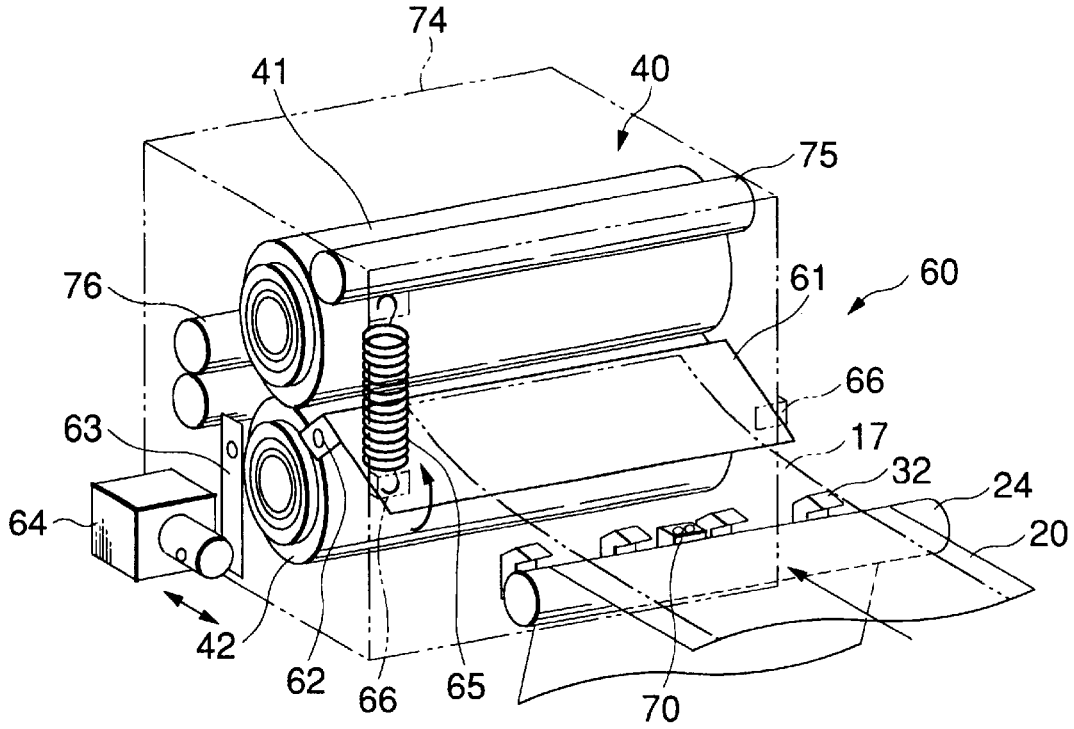
FIG. 3 is a perspective view illustrative of a sheet guide mechanism used in mode of embodiment 1.

As shown in FIG. 3, the sheet guide mechanism 60 has a platelike sheet guide 61 with one end thereof serving as a pivot 62, and also has an electromagnetic solenoid 64 coupled to the pivot 62 of the sheet guide 61 through a rotating lever 63. The electromagnetic solenoid 64 serves as an actuator. The sheet guide mechanism 60 oscillates the sheet guide 61between a reference position (an optimal position for guiding the sheet 17 to the fusing nip region 40*a*) and a retracting position (a position inclined further obliquely downward than the reference position) by on/off operation of the electromagnetic solenoid 64.

In this mode of embodiment, it is designed that the sheet guide 61 retracts to the retracting position when the electromagnetic solenoid 64 turns on. When the electromagnetic solenoid 64 turns off, the sheet guide 61 returns to the reference position by the restitutive force of, e.g., a return spring 65 that is attached to one side on the rotating free end of the sheet guide 61, one side being across the width of the sheet guide 61, and is stopped in position by a pair of stoppers 66 (indicated by a phantom line in FIG. 3) fixedly disposed at predetermined positions of an accommodating housing 74 (indicated by a phantom line in FIG. 3) of the fusing apparatus 40.

It may be noted that in FIG. 3, reference numeral 75 denotes an oil supply roll; and 76, a conveying roll disposed on the exit side of the fusing apparatus 40.

Figure 4:
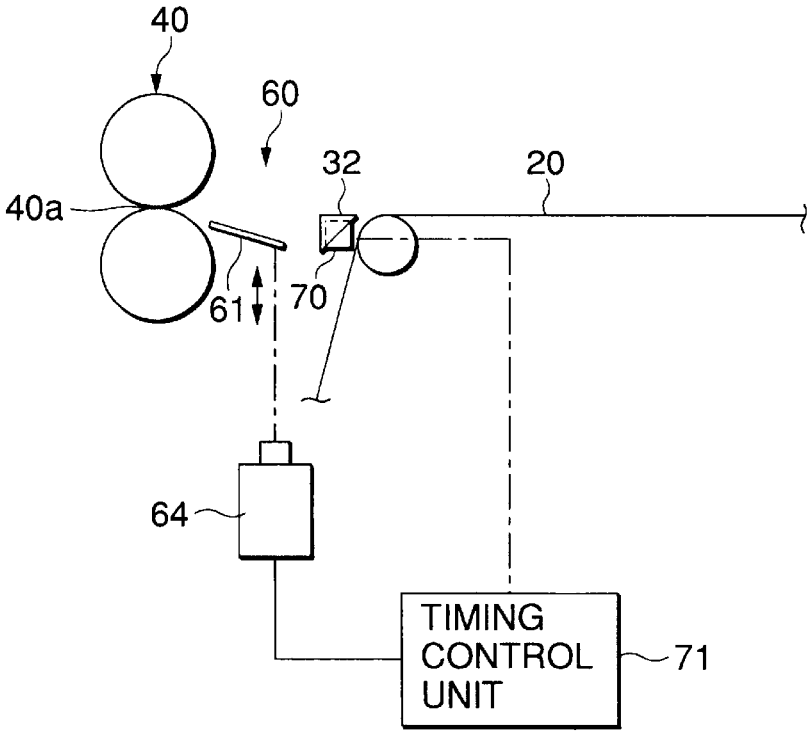
FIG. 4 is a schematic diagram illustrative of the sheet guide mechanism used in mode of embodiment 1.

Further, as shown in FIGS. 3 and 4, a separating sensor 70 is disposed at a predetermined position between the separating protuberances 32 in this mode of embodiment. The separating sensor 70 senses sheet separating timing. In this mode of embodiment, an optical sensor for sensing sheet jams is used also as the separating sensor 70 (while a reflecting type sensor is used in this mode of embodiment, a transmitting type sensor may also be used).

As shown in FIG. 4, a sensed signal from the separating sensor 70 is received by a timing control unit 71. The timing control unit 71 turns on the electromagnetic solenoid 64 at a timing at which the head end of the sheet 17 threads into the fusing nip region 40*a* using the output of the separating sensor 70 as a trigger, and turns off the electromagnetic solenoid 64 at a timing after which the tail end of the sheet 17 tails off from the separating sensor 70.

In this mode of embodiment, when the sheet 17 onto which an image has been transferred by each image forming unit 10 is separated from the sheet conveying belt 20, the head end of the sheet 17 passes through the separating sensor 70.

At this moment, the separating sensor 70 generates a trigger pulse indicating that the head end of the sheet 17 has passed through the sensor 70, and sends the trigger pulse to the timing control unit 71.

Figure 5A:
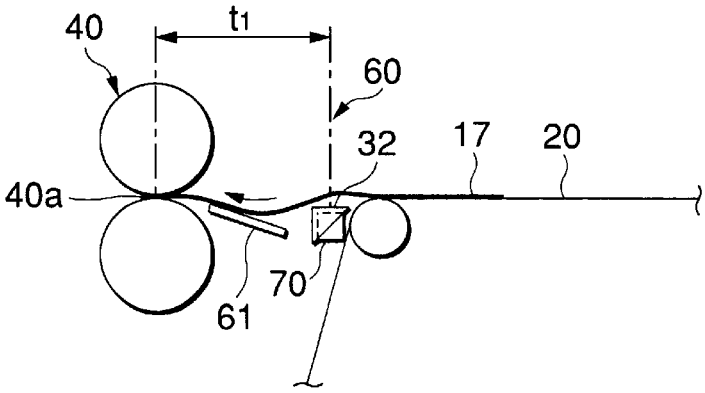
FIGS. 5A and 5B are diagrams illustrative of a sheet guiding process by the sheet guide mechanism used in mode of embodiment 1.

Then, as shown in FIG. 5A, the head end of the separated sheet 17 is guided smoothly to the fusing nip region 40*a* along the sheet guide 61 set at the reference position, and threads into the fusing nip region 40*a*.

Figure 5B:
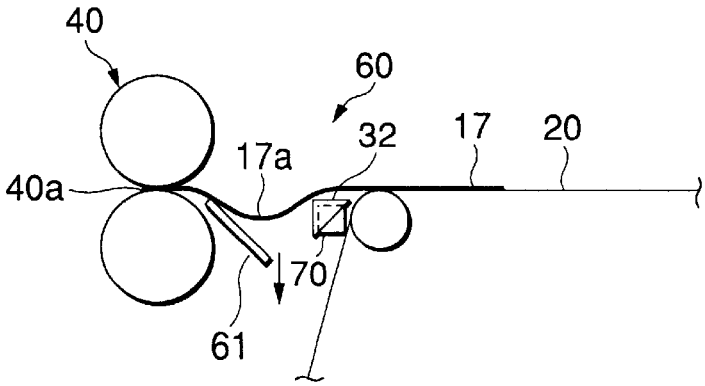

Such threading timing comes after a predetermined time t1 has elapsed from the generation of the trigger pulse, and it is at this timing t1 that the timing control unit 71 turns on the electromagnetic solenoid 64 and that the sheet guide 61 is caused to retract to the retracting position as shown in FIG. 5B.

The distance between the separating sensor 70 and the fusing nip region 40*a* can be defined as a fixed value since sheets come to pass along the same passage even if different sheet movements derived from modified sheets and different grammages is considered. As a result, the time required for the sheet to thread in can be determined by the sheet moving speed. Hence, the speed at which the sheet 17 threads into the fusing nip region 40*a* depends on the sheet conveying belt 20.

It may be noted that the same applies to the modes of embodiment to be described later, in which a sheet conveying unit other than the sheet conveying belt 20 (a transfer drum, an intermediate transfer body such as an intermediate transfer belt, an image carrying body such as a photosensitive drum and a photosensitive belt) is employed.

The above will be described more specifically. For example, when the distance between the separating point and the fusing nip region 40*a* was 101 mm and the sheet conveying speed was 160.046 mm/sec, then the passing time was 0.631 sec, which is an almost constant value, with the grammage ranging from 64 gsm to 220 gsm. It was so specified that the electromagnetic solenoid 64 is turned on 0.7 sec after, taking into account sheet conveying variations, timer variations in the sequence program, follow-up delay of the electromagnetic solenoid 64.

As a result, the sheet 17 loops based on the difference between the conveying speed of the fusing apparatus 40 and the conveying speed of the sheet conveying belt 20. However, the sheet guide 61 is in the retracting position so that a loop 17*a* of the sheet 17 does not interfere with the sheet guide 61. Therefore, the loop 17*a* of the sheet 17 does not receive a reaction force unnecessarily from the sheet guide 61.

As a result, the initially desired effect of not regulating the looping of the sheet 17 can be obtained while ensuring stable threadability of the sheet 17 into the fusing nip region 40*a*.

Further, since the electromagnetic solenoid 64 turns off upon passage of the tail end of the sheet 17 through the separating sensor 70 in this mode of embodiment, the timing at which the electromagnetic solenoid 64 turns on is determined at a single value by the sheet size. Therefore, the sheet guide 61 returns to the initial position (reference position) so as be in time for guiding a next nonfused sheet.

Mode of embodiment 2

Figure 6:
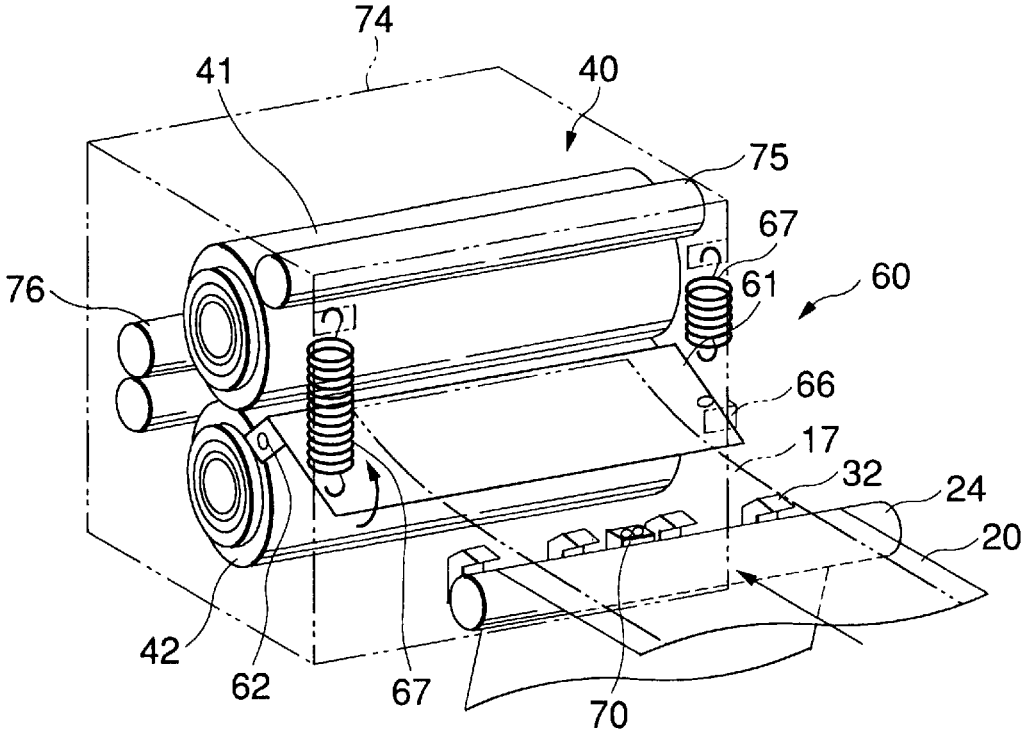
FIG. 6 is a perspective view illustrative of a sheet guide mechanism used in mode of embodiment 2.
Figure 7:
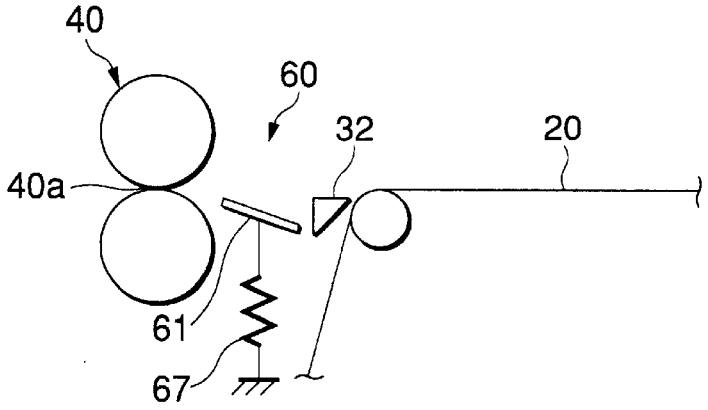
FIG. 7 is a schematic diagram illustrative of the sheet guide mechanism used in mode of embodiment 2.

FIGS. 6 and 7 show a sheet guide mechanism 60 used in a color image forming apparatus, which is mode of embodiment 2, to which the invention is applied.

In FIGS. 6 and 7, the sheet guide mechanism 60 has a platelike sheet guide 61 with one end thereof serving as a pivot 62. This sheet guide mechanism 60 not only has a pair of elastic springs 67 (part of one of the elastic springs is not shown) on both sides across the width of the sheet guide 61 so that the sheet guide 61 is elastically supported, but also has a stopper 66 so that the sheet guide 61 can be regulated at the reference position. It may be noted that in FIGS. 6 and 7, parts and components similar to those of mode of embodiment 1 are denoted as reference numerals similar to those in mode of embodiment 1 and that detailed descriptions of those parts and components will be omitted.

Figure 8A:
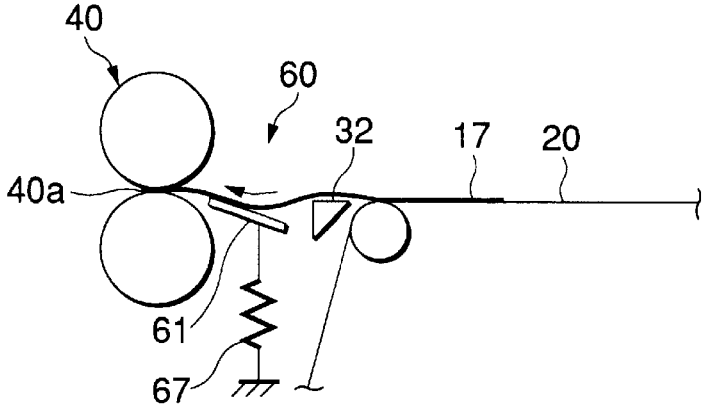
FIGS. 8A and 8B are diagrams illustrative of a sheet guiding process by the sheet guide mechanism used in mode of embodiment 2.

Therefore, according to this mode of embodiment, when the head end of the sheet 17 is separated from the sheet conveying belt 20, the head end of the sheet 17 is smoothly guided to the fusing nip region 40*a* along the sheet guide 61 as shown in FIG. 8A.

Figure 8B:
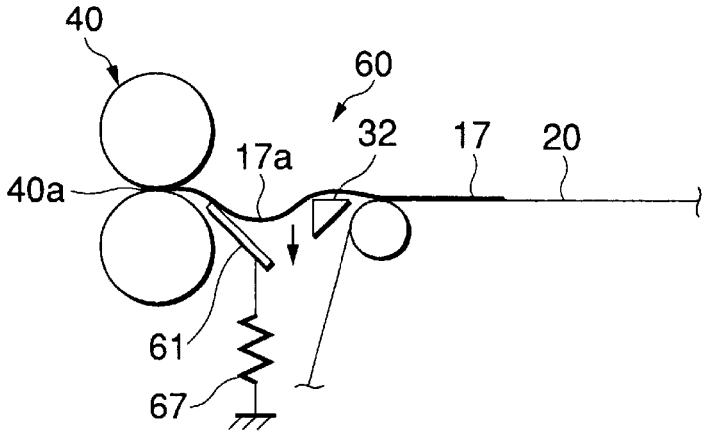

When the head end of the sheet 17 thereafter threads into the fusing nip region 40*a*, the sheet 17 starts looping as shown in FIG. 8B, but the sheet guide 61 is displaced while absorbing the loop 17*a* of the sheet 17 with the elastic supporting force of the elastic springs 67.

That is, in this mode of embodiment, the elastic springs 67 must have the following characteristic. The springs 67 must be able to absorb the loop 17*a* of the sheet 17 with a minimum reaction force thereof, and must be able to cause the sheet guide 61 to return to the initial position within a shortest possible time after the sheet 17 has passed through the sheet guide 61.

To give the aforementioned characteristic to the springs, it is so designed that the elastic springs 67 urge the loop 17*a* of the sheet 17 with a reaction force of 0.5N when the maximum loop height of the sheet 17 is 15 mm. Since the inertial mass of the sheet guide 61 is 0.3 Kg at the points where the sheet guide 61 is supported by the elastic springs 67, the tension of the elastic springs 67 at the maximum load position is 3.44 N and 3N at the return position.

The time required for return was 20 msec. which is short enough compared with a minimum gap between sheets of 150 msec and which therefore imposes no practical problem. Further, although this return time is calculated to be 10 msec or less, the actual return time is longer than that since the moving load is applied. Although the reaction force of 0.5N causes the sheet conveying belt 20 to walk, the degree of such force affecting the sheet conveying belt 20 is in the order or several $\mu$ or less, which is practically negligible.

While the aforementioned values have been selected since the test was carried with a test machine that has the same construction as that of mode of embodiment 1, the invention is not restricted by these selected values only.

Mode of embodiment 3

Figure 9:
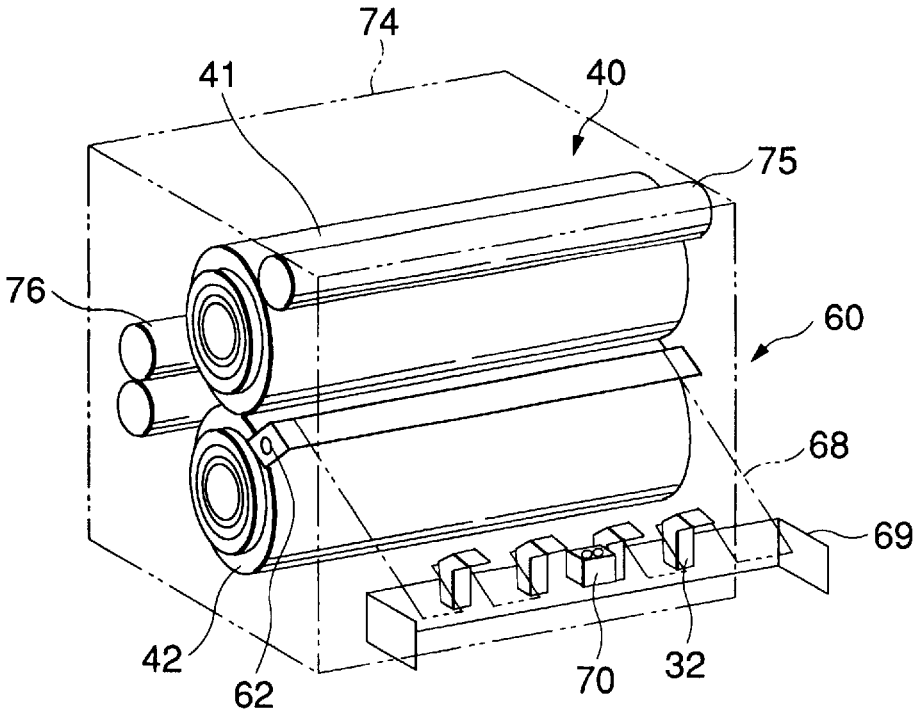
FIG. 9 is a perspective view illustrative of a sheet guide mechanism used in mode of embodiment 3.
Figure 10:
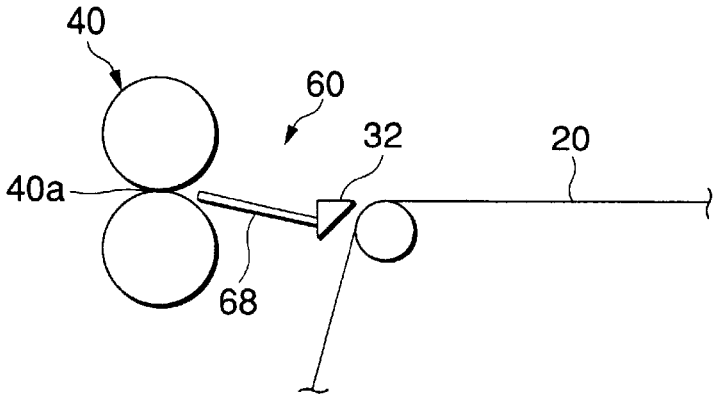
FIG. 10 is a schematic diagram illustrative of the sheet guide mechanism used in mode of embodiment 3.

FIGS. 9 and 10 show a sheet guide mechanism 60 used in a color image forming apparatus, which is mode of embodiment 3, to which the invention is applied.

In FIGS. 9 and 10, the sheet guide mechanism 60 is such that a platelike sheet guide 68 itself is constructed of a spring member (e.g., a PET member whose thickness is 0.15 mm). One end of the sheet guide 68 serves as a pivot 62, and the other end thereof is fixed through a bracket 69. The sheet guide 68 is arranged at an oblique position corresponding to a predetermined reference position. It may be noted that in FIGS. 9 and 10, parts and components similar to those of mode of embodiment 1 are denoted as reference numerals similar to those in mode of embodiment 1 and that detailed descriptions of these parts and components will be omitted.

Figure 11A:
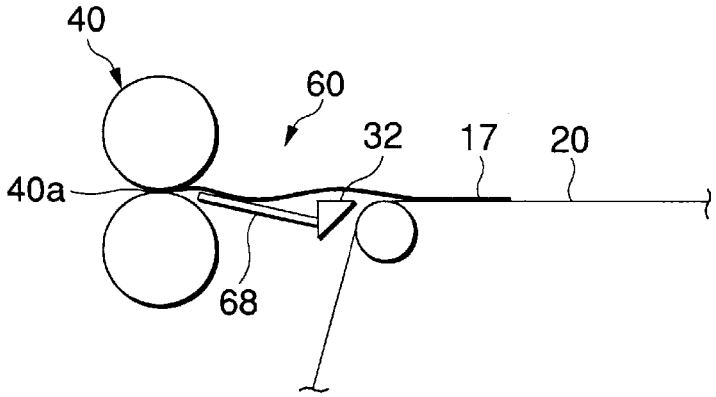
FIGS. 11A and 11B are diagrams illustrative of a sheet guiding process by the sheet guide mechanism used in mode of embodiment 3.

Therefore, according to this mode of embodiment, when the head end of the sheet 17 is separated from the sheet conveying belt 20, the head end of the sheet 17 is smoothly guided to the fusing nip region 40*a* along the sheet guide 68 (that takes the oblique position corresponding to the reference position) as shown in Fig. 11A.

Figure 11B:
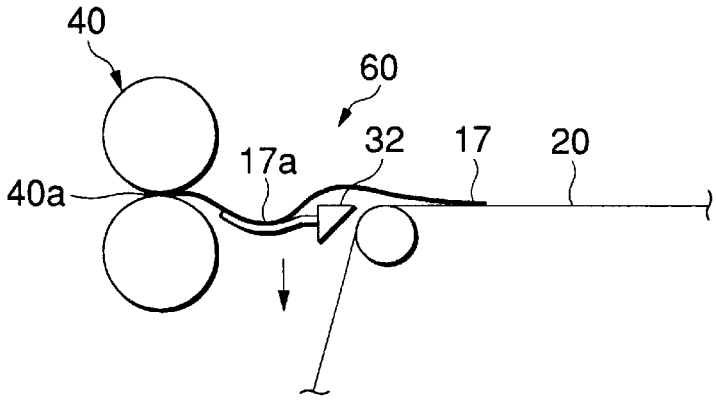

When the head end of the sheet 17 thereafter threads into the fusing nip region 40*a*, the sheet 17 starts looping as shown in FIG. 11B, but the sheet guide 68 is displaced while absorbing the loop 17*a* of the sheet 17 with the elastic action thereof.

Therefore, in this mode of embodiment, the sheet guide 68 itself is a spring member. The major object of this design is to avoid inconvenience and to reduce the cost of manufacture.

While a PET member having a thickness is 0.15 mm is used as a material to carry the test, there is no restriction on the material and thickness of the sheet guide 68 as long as the force for collapsing the loop 17*a* is small as indicated in mode of embodiment 2.

Further, since the sheet guide 68 is designed to guide the head end of the sheet 17, it goes without saying that smaller thicknesses are more preferable as long as the sheet guide 68 can guide large sheets 17 having large grammage.

Test results similar to those obtained in mode of embodiment 2 were obtained.

This mode of embodiment is satisfactory for initial operation. However, when secular change as well as operating conditions close to high temperature sections in particular are taken into consideration, heat resistant materials such as polyimide that has high-temperature resistance may preferably be used.

Mode of embodiment 4

Figure 12:
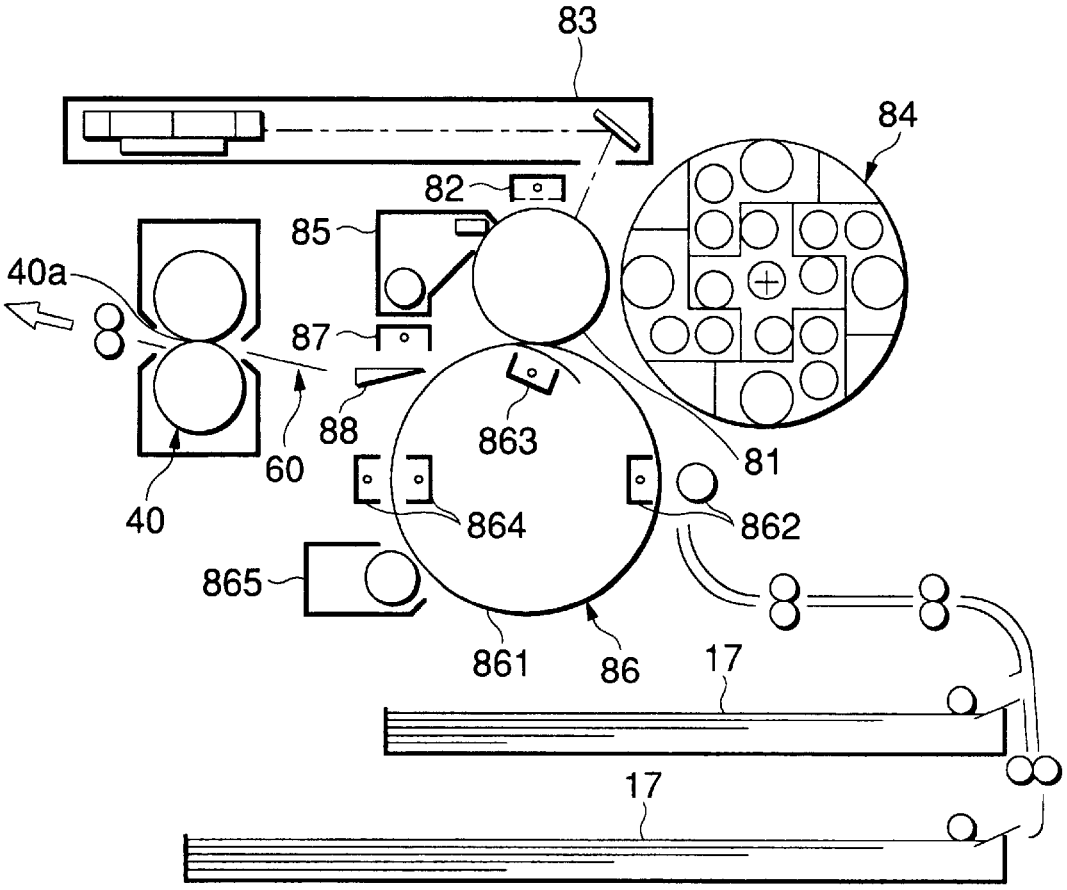
FIG. 12 is a diagram outlining an image forming apparatus, which is mode of embodiment 4.

FIG. 12 outlines a color image forming apparatus, which is mode of embodiment 4, to which the invention is applied.

In FIG. 12, the color image forming apparatus has, around a photosensitive drum 81, an electrostatically charging device 82, an exposing device 83, a rotary developing apparatus 84 having developing units for different color components mounted thereon, and a cleaner 85 for removing residual toner. Further, the color image forming apparatus has a transfer drum 86 (in this mode of embodiment, a transfer drum 86 not only having an insulating drum sheet 861 layered over the circumferential surface of the drum main body, but also having an electrostatically adsorbing device 862 for adsorbing the sheet 17, a transfer device 863 for transferring a toner image, a static eliminator device 864 for eliminating electrostatic charges from the drum sheet, and a sheet cleaner 865 for cleaning the drum sheet arranged around the drum sheet 861 is used) at a transfer region on the photosensitive drum 81. Not only toner images of the respective color components are sequentially formed on the photosensitive drum 81, but also these toner images are sequentially transferred onto a sheet 17 held on the transfer drum 86. When the transfer processes for the respective color components have been terminated, the sheet 17 is separated from the transfer drum 86 by the separating device 87 and the separating protuberances 88, and the separated sheet 17 is then guided to the fusing nip region 40*a* of the fusing apparatus 40 by the sheet guide mechanism 60.

Here, a sheet guide mechanism 60 similar to those of modes of embodiment 1 to 3 can be used, so that similarly to modes of embodiment 1 to 3, there is no likelihood that an unnecessary axially directed external force will be applied to the transfer drum 86 attributable to the reaction force from the sheet guide 61 (68).

As a result, even if the tail end of the sheet 17 is passing through the transfer section when the head end of the sheet 17 has threaded into the fusing nip region 40*a* of the fusing apparatus 40, there is no likelihood that defective color superimposition will be caused by the meandering of the transfer drum 86.

Mode of embodiment 5

Figure 13:
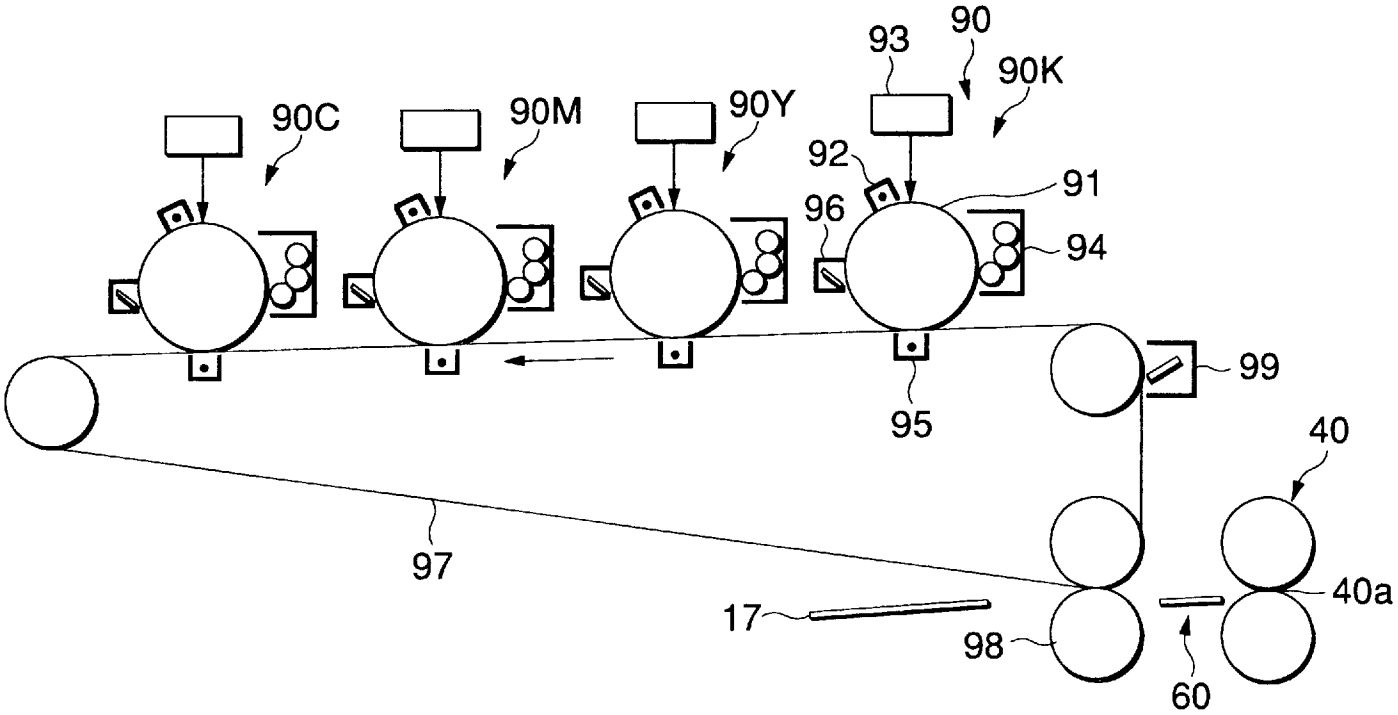
FIG. 13 is a diagram outlining an image forming apparatus, which is mode of embodiment 5.

FIG. 13 outlines a color image forming apparatus, which is mode of embodiment 5, to which the invention is applied.

In FIG. 13, the color image forming apparatus has a plurality of image forming units 90 (specifically, 90K, 90Y, 90M, 90C) (in this mode of embodiment, image forming units 90, each having, an electrostatically charging device 92, an exposing device 93, a developing device 94 having toners of different color components contained therein, a primary transfer device 95, and a cleaner 96 arranged around a photosensitive drum 91, are, e.g., used). Not only an endless intermediate transfer belt 97 is arranged so that the intermediate transfer belt 97 extends so as to correspond to transfer regions of the respective image forming units 90, but also the primary transfer devices 95 are arranged so as to confront the transfer regions of the respective image forming units 90 through the intermediate transfer belt 97. As a result, images of different color components formed by the respective image forming units 90 are sequentially transferred onto the intermediate transfer belt 97; the thus formed primarily transferred images on the intermediate transfer belt 97 are secondarily transferred onto a sheet 17 by a secondary transfer device 98; and the sheet 17 separated from the bent portion of the intermediate transfer belt 97 (with separating protuberances arranged as necessary) is guided to the fusing nip region 40*a* of the fusing apparatus 40 through a sheet guide mechanism 60. It may be noted that reference numeral 99 denotes a belt cleaner that removes residual toner on the intermediate transfer belt 97.

Here, a sheet guide mechanism 60 similar to those of modes of embodiment 1 to 3 can be used, so that similarly to modes of embodiment 1 to 3, there is no likelihood that an unnecessary axially directed external force will be applied to the intermediate transfer belt 97 attributable to the reaction force from the sheet guide 61 (68).

As a result, even if the tail end of the sheet 17 is passing through the transfer section when the head end of the sheet 17 has threaded into the fusing nip region 40*a* of the fusing apparatus 40, there is no likelihood that image distortion will be caused by the meandering of the intermediate transfer belt 97.

Mode of embodiment 6

Figure 14:
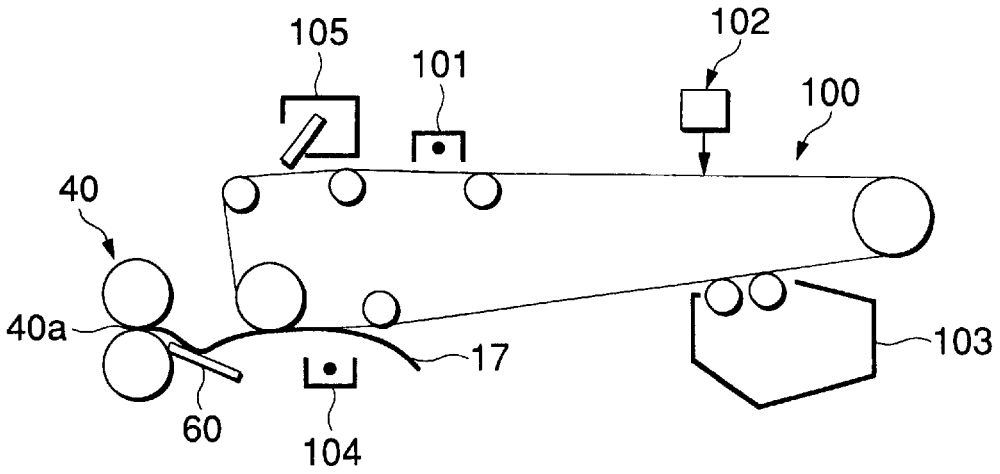
FIG. 14 is a diagram outlining an image forming apparatus, which is mode of embodiment 6.

FIG. 14 outlines a color image forming apparatus, which is mode of embodiment 6, to which the invention is applied.

The color image forming apparatus shown in FIG. 14 is an electrophotographically operated monochromatic image forming apparatus, and has, around a photosensitive belt 100, an electrostatically charging device 101, an exposing device 102, a developing device 103, a transfer device 104, and a cleaner 105. Electrostatic charging, exposing and developing processes are effected onto the photosensitive belt 100; a toner image formed on the photosensitive belt 100 is transferred onto a sheet 17 by the transfer device 104; and the sheet 17 separated from the bent portion of the photosensitive belt 100 (with separating protuberances arranged as necessary) is guided to the fusing nip region 40*a* of the fusing apparatus 40 through a sheet guide mechanism 60.

Here, a sheet guide mechanism 60 similar to those of modes of embodiment 1 to 3 can be used, so that similarly to modes of embodiment 1 to 3, there is no likelihood that an unnecessary axially directed external force will be applied to the photosensitive belt 100 attributable to a reaction force from the sheet guide 61 (68).

As a result, even if the tail end of the sheet 17 is passing through the transfer section when the head end of the sheet 17 has threaded into the fusing nip region 40*a* of the fusing apparatus 40, there is no likelihood that image distortion will occur due to the meandering of the photosensitive belt 100.

Mode of embodiment 7

Figure 15:
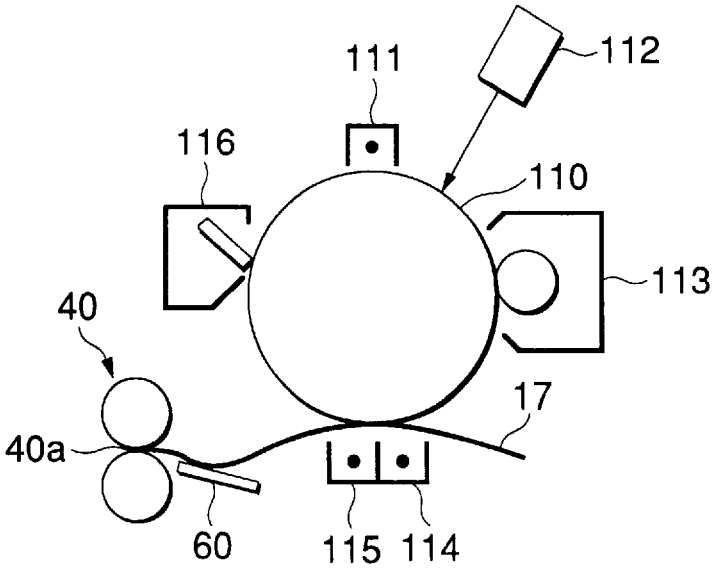
FIG. 15 is a diagram outlining an image forming apparatus, which is mode of embodiment 7.
Figure 16:
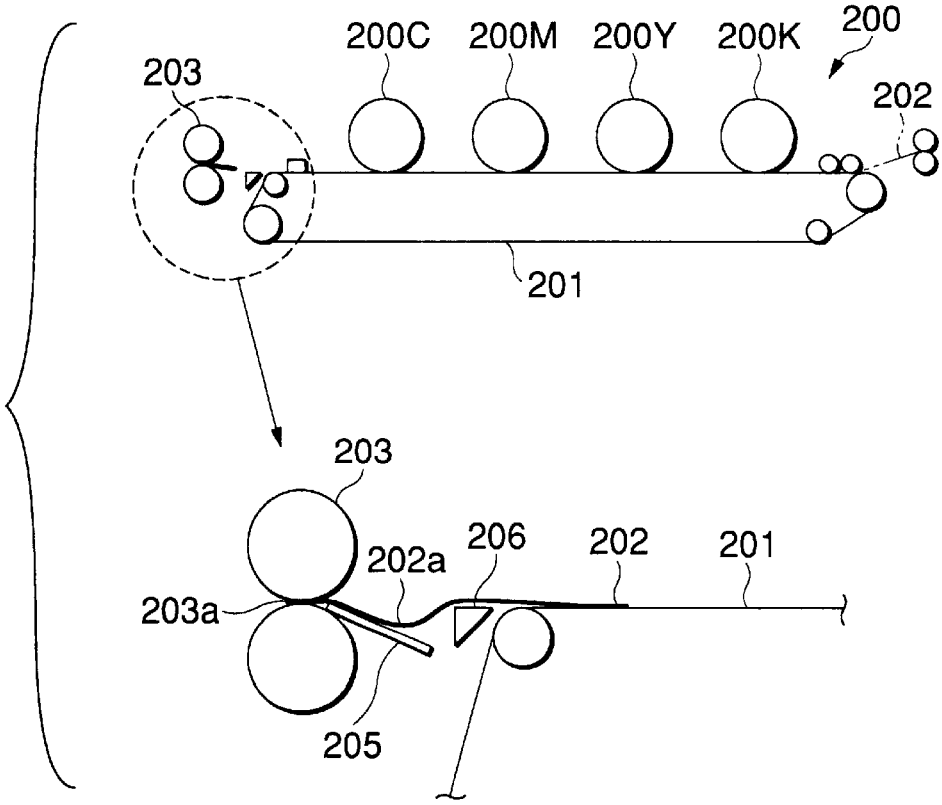
FIG. 16 is a diagram illustrative of an exemplary conventional image forming apparatus.
Figure 17:
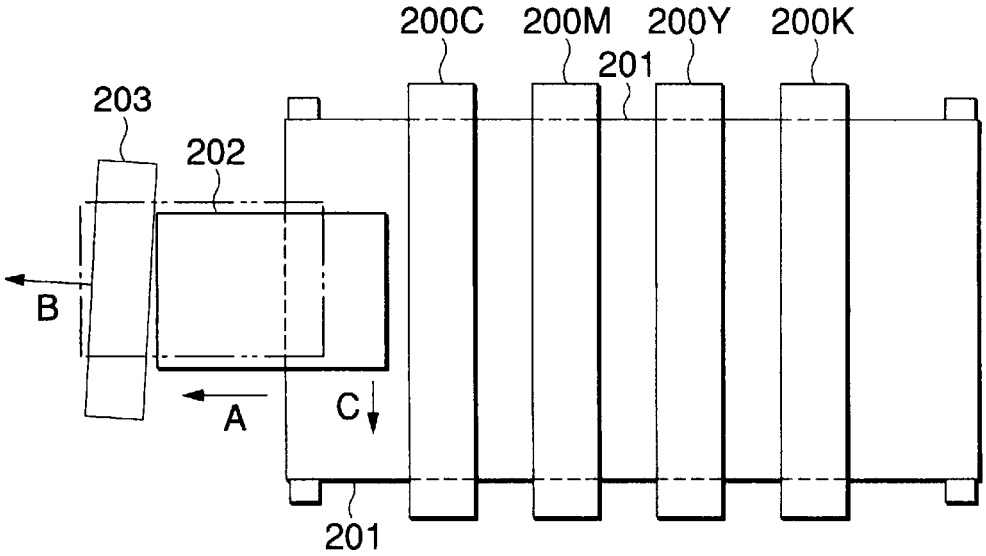
FIG. 17 is a plan view illustrative of inconvenience addressed by the conventional image forming apparatus.

FIG. 15 outlines a color image forming apparatus, which is mode of embodiment 7, to which the invention is applied.

The color image forming apparatus shown in FIG. 15 is an electrophotographically operated monochromatic image forming apparatus, and has, around a photosensitive drum 110, an electrostatically charging device 111, an exposing device 112, a developing device 113, a transfer device 114, a sheet separating device 115, and a cleaner 116. Electrostatic charging, exposing, and developing processes are effected onto the photosensitive drum 110; a toner image formed on the photosensitive drum 110 is transferred onto a sheet 17 by the transfer device 114; and the sheet 17 separated from the photosensitive drum 110 by the sheet separating device 115 (with separating protuberances arranged as necessary) is guided to the fusing nip region 40*a* of the fusing apparatus 40 through a sheet guide mechanism 60.

Here, a sheet guide mechanism 60 similar to those of modes of embodiment 1 to 3 can be used, so that similarly to modes of embodiment 1 to 3, there is no likelihood that an unnecessary axially directed external force will be applied to the photosensitive drum 110 attributable to a reaction force from the sheet guide 61 (68).

As a result, even if the tail end of the sheet 17 is passing through the transfer section when the head end of the sheet 17 has threaded into the fusing nip region 40*a* of the fusing apparatus 40, there is no likelihood that image distortion will occur due to the meandering of the photosensitive drum 110.

Figure 1A:
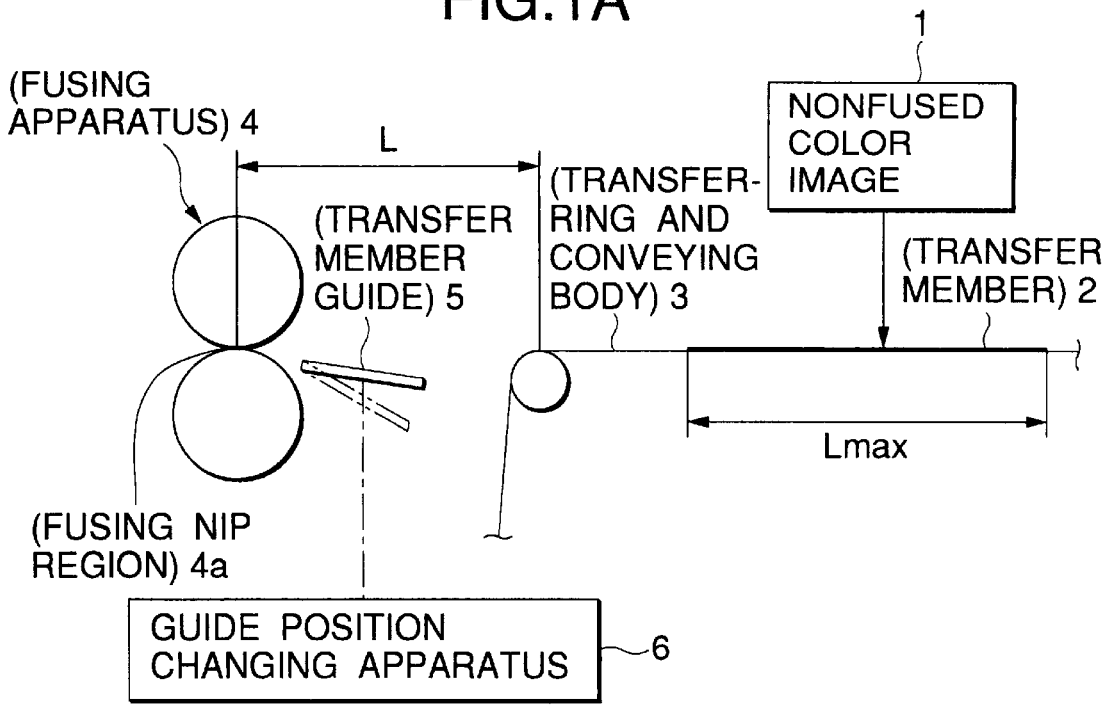
FIG. 1A is a diagram illustrative of a construction of an image forming apparatus, which is basic mode of the present invention.

That is, as shown in FIG. 1A, the invention is applied to an image forming apparatus includes: a transferring and conveying body 3 for transferring a nonfused image 1 onto a transfer member 2 and conveying the transfer member 2; a fusing apparatus 4 that is arranged so as to be distanced from the transferring and conveying body 3 a distance L that is shorter than a maximum transfer member length Lmax and that fuses an image on the transfer member 2; and a transfer member guide 5 that is interposed between the transferring and conveying body 3 and the fusing apparatus 4 and that guides the transfer member 2 to thread into a fusing nip region 4*a* of the fusing apparatus 4. In such image forming apparatus, a guide position changing apparatus 6 is arranged on the transfer member guide 5. The guide position changing apparatus 6 changes a position of the transfer member guide 5 in a direction that a loop 2*a* (see FIG. 1C) of the transfer member 2 is caused when a head end of the transfer member 2 threads into the fusing nip region 4*a* of the fusing apparatus 4.

In such technical means, the nonfused image 1 may be formed by means of electrophotography and various other technologies. It does not matter whether the nonfused image 1 is monochromatic or colored.

Here, the nonfused color image 1 may be formed by transferring images of a plurality of color components collectively or by a multitransfer technique.

Further, while an ordinary sheet is used as the transfer member 2, other types of sheets such as OHP sheets may also be used as long as such sheets allow an image to be transferred thereon.

Further, as the transferring and conveying body 3, various types may be employed as long as such types of transferring and conveying bodies allow the nonfused image 1 to be transferred onto the transfer member 2 and allow the transfer member 2 to be conveyed toward the fusing apparatus 4.

For example, the transferring and conveying body may be a transferring and conveying member that holds and conveys the transfer member 2. The transferring and conveying body may also be an intermediate transfer body that is arranged so that the intermediate transfer body extends so as to confront an image carrying body (a photosensitive body, a dielectric body, or the like) carrying a nonfused image 1 at the time of forming the nonfused image 1 and that indirectly transfers the nonfused image 1 formed on the image carrying body onto the transfer member 2. Further, an image carrying body that carries a nonfused image 1 at the time of forming the nonfused image 1 may be acceptable. The transferring and conveying body may take various modes. It does not matter whether the transferring and conveying body is endless beltlike or drumlike.

Still further, the fusing apparatus 4 may be selected from various modes suitably. The fusing apparatus 4 may be constructed of a pair of fusing rolls (a pair of heat rolls or a pair of pressure rolls), a pair of a heat belt and a pressure roll, or the like. By the term "the fusing nip region 4*a*" it is intended to mean a nip region that is necessary for fusing and that extends between the fusing rolls, between the heat belt and the pressure roll, or the like.

Further, any transfer member guide 5 may be used as long as the position for guiding the head end of the transfer member 2 to the fusing nip region 4*a* of the fusing apparatus 4 is selected as a reference position. In selecting the reference position, there is no need for considering the loop 2*a* of the transfer member 2 at all.

Further, the guide position changing apparatus 6 may be such that the transfer member guide 5 is displaced from the reference position so that the transfer member guide 5 will not interfere with the loop 2*a* of the transfer member 2 at the time the loop 2*a* is produced.

Here, the displacement mode of the transfer member guide 5 may be selected suitably. The transfer member guide 5 may be displaced by changing the inclined position, or by moving in parallel with the inclined position unchanged. Further, as for the degree of displacement of the transfer member guide 5, it is preferable that the transfer member guide 5 be displaced so that the transfer member guide 5 will never interfere with the loop 2*a* of the transfer member 2. However, as long as the reaction force of the transfer member 2 does not adversely affect the transferring and conveying body 3, the degree of displacement of the transfer member guide 5 may be such as to slightly deform the loop 2*a*.

For example, the guide position changing apparatus 6 may be an actuator such as a solenoid that retracts the position of the transfer member guide 5 from a reference position at a timing at which the head end of the transfer member 2 has threaded into the fusing nip region 4*a* of the fusing apparatus 4.

In the case of using such an actuator, it is required that the position of the transfer member guide 5 be returned to the reference position after a timing at which the tail end of the transfer member 2 has moved away from the transferring and conveying body 3.

Further, the operation timing of such actuator is controlled by a sensed signal from, e.g., a transfer member 2 passage position sensing apparatus.

Here, the transfer member 2 passage position sensing apparatus may be selected suitably. For example, a transfer member 2 jam sensing apparatus or the like may be used also as the transfer member passage position sensing apparatus, or a positioning roll drive timing may be utilized.

As other mode of the guide position changing apparatus 6, an elastic support mechanism that elastically displaces the transfer member guide 5 in accordance with the loop 2*a* of the transfer member 2 may be selected. Further, the transfer member guide 5 may be constructed of an elastically deformable material so that the guide position changing apparatus 6 can deform the transfer member guide 5 elastically in accordance with the loop 2*a* of the transfer member 2.

An operation of the aforementioned technical means will be described next.

Figure 1B:
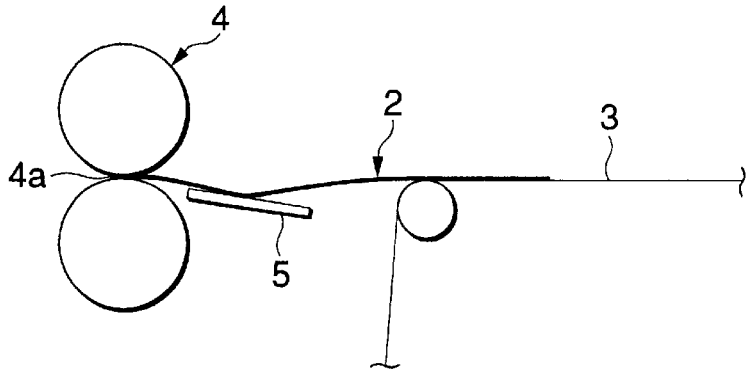
FIG. 1B is a diagram illustrative of a condition in which a transfer member guide is set to a reference position in basic mode of the invention.

As shown in FIG. 1B, the transfer member guide 5 is set to the reference position (the optimal inclined position to guide the transfer member to the fusing nip region 4*a* of the fusing apparatus 4) in advance. Therefore, the head end of the transfer member 2 separated from the transferring and conveying body 3 is guided smoothly toward the fusing nip region 4*a* along the transfer member guide 5.

Figure 1C:
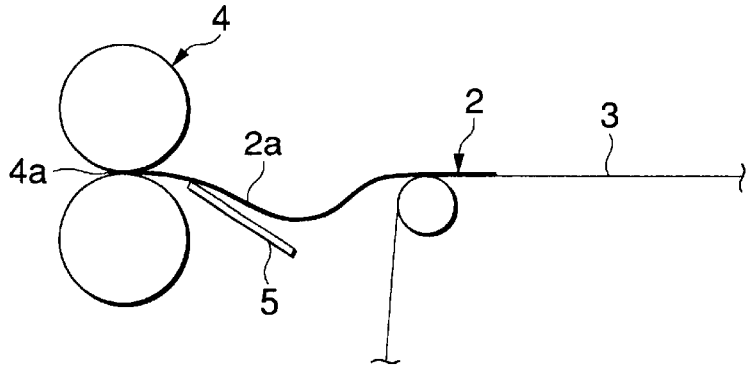
FIG. 1C is a diagram illustrative of a condition in which the transfer member guide is retracting from the reference position in basic mode of the invention.

Then, as shown in FIG. 1C, the guide position changing apparatus 6 changes the position of the transfer member guide 5 in a direction that the loop 2*a* of the transfer member 2 is caused at a timing at which the head end of the transfer member 2 threads into the fusing nip region 4*a* of the fusing apparatus 4.

As described in the foregoing, according to the invention, a transfer member is smoothly guided to a fusing nip region of a fusing apparatus by a transfer member guide, and in addition, the position of the transfer member guide is changed by a guide position changing apparatus so as to absorb a loop of the transfer member when the head end of the transfer member has threaded into the fusing nip region. Therefore, there is little likelihood that the loop of the transfer member will be regulated by the transfer member guide, which in turn allows a reaction force from the transfer member guide to be seldom applied to the transfer member.

As a result, even if the tail end of the transfer member does remain on the transferring and conveying body side, there is little likelihood that a reaction force will be applied by the transfer member to the transferring and carrying body in a meandering direction, which in turn contributes to effectively avoiding inconvenience to the transferring and carrying body (image distortion, defective color superimposition, edge losses, and the like due to meandering) caused by the reaction force of the transfer member guide to the transfer member. Hence, not only high quality images can be produced by controlling image writing position with high accuracy, but also the transfer member can be guided stably to the fusing apparatus.

Moreover, according to the invention, the guide position changing apparatus is arranged on the transfer member guide, which is a simple construction. That is, to prevent the loop of the transfer member from growing, it is no longer necessary to effect variable speed control on the fusing apparatus by sensing the loop of the transfer member nor is it necessary to employ a means for expanding the transfer member guide in a transfer member travelling direction in accordance with the size of the transfer member. Therefore, the structure of the apparatus can be simplified while downsizing the apparatus.

What is claimed is:

1. An image forming apparatus comprising:

a transferring and conveying body for transferring a nonfused image onto a transfer member and conveying the transfer member;

a fusing means being arranged so as to be distanced from said transferring and conveying body a distance that is shorter than a maximum transfer member length and fusing an image on the transfer member;

a transfer member guide being interposed between said transferring and conveying body and said fusing means and guiding the transfer member to thread into a fusing nip region of the fusing means; and a guide position changing means being arranged on said transfer member guide, said guide position changing means changing a position of said transfer member guide in a direction that a loop of the transfer member is caused when a head end of the transfer member threads into said fusing nip region of said fusing means.

2. An image forming apparatus according to claim 1, wherein said guide position changing means is an actuator for retracting the position of said transfer member guide from a reference position at a timing at which the head end of the transfer member has threaded into said fusing nip region of said fusing means.

3. An image forming apparatus according to claim 2, wherein the operation timing of the guide position changing means is controlled by a sensed signal from a transfer member passage position sensing means.

4. An image forming apparatus according to claim 1, wherein said guide position changing means is an actuator for returning the position of said transfer member guide to the reference position after a timing at which a tail end of the transfer member has moved away from said transferring and conveying body.

5. An image forming apparatus according to claim 4, wherein the operation timing of the guide position changing means is controlled by a sensed signal from a transfer member passage position sensing means.

6. An image forming apparatus according to claim 1, wherein said guide position changing means is an elastic support mechanism for elastically displacing said transfer member guide in accordance with the loop of the transfer member.

7. An image forming apparatus according to claim 1, wherein said transfer member guide is constructed of an elastically deformable material so that said guide position changing means allows said transfer member guide to be elastically deformed in accordance with the loop of the transfer member.

8. An image forming apparatus according to claim 1, wherein the nonfused image to be transferred onto the transfer member is formed by transferring a plurality of images of different color components collectively or by a multitransfer technique.

9. An image forming apparatus according to claim 1, wherein said transferring and conveying body is a conveying member of the transfer member for holding and conveying the transfer member.

10. An image forming apparatus according to claim 1, wherein said transferring and conveying body is an intermediate transfer body being arranged so as to confront an image carrying body for carrying a nonfused image at the time of forming the nonfused image and indirectly transferring the nonfused image formed on said image carrying body onto the transfer member.

11. An image forming apparatus according to claim 1, wherein said transferring and conveying body is an image carrying body for carrying a nonfused image at the time of forming the nonfused image.

12. An image forming apparatus according to claim 1, wherein said transferring and conveying body is endless beltlike.

13. An image forming apparatus according to claim 1, wherein said transferring and conveying body is drumlike.

* * * * *